US008898817B1

(12) United States Patent
Morales et al.

(10) Patent No.: US 8,898,817 B1
(45) Date of Patent: Dec. 2, 2014

(54) INTERCHANGEABLE PATCH DEVICE

(76) Inventors: Yannik Morales, Dixon, CA (US); Jennifer Morales, Dixon, CA (US)

( * ) Notice: Subject to any disclaimer, the term of this patent is extended or adjusted under 35 U.S.C. 154(b) by 932 days.

(21) Appl. No.: 13/018,025

(22) Filed: Jan. 31, 2011

(51) Int. Cl.
*A41D 27/20* (2006.01)
*A41B 1/08* (2006.01)
*A45F 5/02* (2006.01)

(52) U.S. Cl.
CPC ..... *A45F 5/02* (2013.01); *A41D 27/205* (2013.01)
USPC ..... 2/250; 2/122; 2/251

(58) Field of Classification Search
CPC ..... A41B 1/00; A41D 27/08; A41D 27/20; A41D 27/201; A41D 13/0012; A45F 5/02; A45F 2200/05–2200/0591
USPC ..... 2/119, 122, 244, 247, 249–252
See application file for complete search history.

(56) References Cited

U.S. PATENT DOCUMENTS

| | | | | | |
|---|---|---|---|---|---|
| 2,527,258 | A | * | 10/1950 | Kahn | 40/586 |
| 3,193,842 | A | | 7/1965 | Beel | |
| 4,602,390 | A | * | 7/1986 | Morera et al. | 2/251 |
| 4,613,991 | A | * | 9/1986 | Grover | 2/23 |
| 4,899,395 | A | * | 2/1990 | Spector | 2/250 |
| 4,924,613 | A | * | 5/1990 | Levin | 40/586 |
| 4,975,987 | A | | 12/1990 | Teachout et al. | |
| 5,086,516 | A | * | 2/1992 | Baxter et al. | 2/108 |
| 5,359,734 | A | * | 11/1994 | Rathburn | 2/195.1 |
| 5,379,461 | A | * | 1/1995 | Wilmers | 2/115 |
| 5,737,775 | A | * | 4/1998 | Schwartz | 2/247 |
| 5,826,717 | A | * | 10/1998 | Eskandry | 206/308.1 |
| D401,738 | S | | 12/1998 | Scerbo | |
| 5,960,476 | A | * | 10/1999 | Danzy | 2/115 |
| 6,012,575 | A | * | 1/2000 | Eskandry | 206/308.1 |
| 6,085,353 | A | * | 7/2000 | van der Sleesen | 2/69 |
| 6,115,948 | A | * | 9/2000 | Mitchell | 36/136 |
| 6,186,321 | B1 | * | 2/2001 | Eskandry | 206/308.1 |
| 6,199,210 | B1 | | 3/2001 | Feldman | |
| 6,253,385 | B1 | | 7/2001 | Fields | |
| 6,409,013 | B1 | * | 6/2002 | Eskandry | 206/308.1 |
| D468,532 | S | * | 1/2003 | Hassett | D3/285 |
| 6,519,779 | B1 | * | 2/2003 | Taguchi | 2/209.12 |
| 6,526,589 | B1 | * | 3/2003 | Jeziak et al. | 2/69 |
| 7,467,418 | B2 | * | 12/2008 | Kronenberger | 2/1 |
| 2007/0164064 | A1 | * | 7/2007 | Nathan | 224/153 |
| 2008/0047863 | A1 | * | 2/2008 | Friou et al. | 206/457 |
| 2008/0189830 | A1 | * | 8/2008 | Egglesfield | 2/244 |
| 2009/0117296 | A1 | * | 5/2009 | Nicastri | 428/14 |
| 2009/0158489 | A1 | * | 6/2009 | White et al. | 2/69 |
| 2009/0158502 | A1 | * | 6/2009 | Medolla et al. | 2/227 |
| 2009/0260123 | A1 | * | 10/2009 | Swift | 2/69 |

* cited by examiner

*Primary Examiner* — Alissa L Hoey
*Assistant Examiner* — Jameson Collier
(74) *Attorney, Agent, or Firm* — Crossley Patent Law

(57) ABSTRACT

An interchangeable patch device including a base portion having a rear side entirely covered with an adhesive that is attached to an item, such as clothing, and an indicia-bearing top portion removably attached to the base portion via a first zipper track continuously disposed along a base perimeter which releasably interlocks with a second zipper track disposed along a perimeter of the top portion. An internal cavity defined by a bottom side of top portion, a top portion wall, the second zipper track, and the base portion front side is provided to store small objects therein, such as a cellular phone, business cards, and pens.

3 Claims, 3 Drawing Sheets

INTERCHANGEABLE PATCH DEVICE

BACKGROUND OF THE INVENTION

Various types of wearable patches are known in the prior art. However, what is needed is an interchangeable patch device including a base portion that is attached to an item, such as clothing, and a logo-bearing top portion removably centrally attached to the base portion via a first zipper track continuously disposed along a base perimeter that interlocks with a second zipper track continuously disposed along a perimeter of the top portion. An internal cavity defined by a bottom side of top portion, a top portion wall, the second zipper track, and the base portion front side is provided to store small objects therein, such as a cellular phone, business cards, and pens.

FIELD OF THE INVENTION

The present invention relates to wearable patches, and more particularly, to an interchangeable patch device.

SUMMARY OF THE INVENTION

The general purpose of the present interchangeable patch device, described subsequently in greater detail, is to provide an interchangeable patch device which has many novel features that result in an interchangeable patch device which is not anticipated, rendered obvious, suggested, or even implied by prior art, either alone or in combination thereof.

To accomplish this, the present interchangeable patch device removably attaches to an item, such as an article of clothing, a briefcase, a lunch cooler, luggage and a host of other personal items, thus permitting a person to decorate personal items as desired. The patch device includes a base portion with an adhesive, such as an iron-on adhesive or glue, disposed on the entire rear side thereof allowing the base portion rear side to attach to the item. A top portion removably attaches to the base portion and has substantially the same shape and dimensions as the base portion. A first zipper track continuously disposed along an entire base portion first perimeter releasably interlocks with a second zipper track disposed along a second perimeter of the top portion. A zipper pull operationally alternately interlocks and releases the second zipper track with and from, respectively, the first zipper track in a closed position and an open position, respectively. The top portion may be completely detached from the base portion to permit the top portion to be replaced with a different top portion having the same dimensions An internal cavity for storing small objects, such as a cellular phone, business cards, pens, an MP3 player, and money, therein is defined by the top portion bottom side, the top portion wall, the second zipper track, and the base portion front side. In an open position, the object may be placed into the internal cavity and then the object is entirely contained therein when the first zipper track and the second zipper track are completely interlocked in a closed position. The top portion top side bears at least one indicia thereon, such as a logo, a photograph, a slogan, or team name.

The present interchangeable patch device is provided in a wide range of shapes, sizes, colors, and styles for virtually unlimited choice in design.

Thus has been broadly outlined the more important features of the present interchangeable patch device and method so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
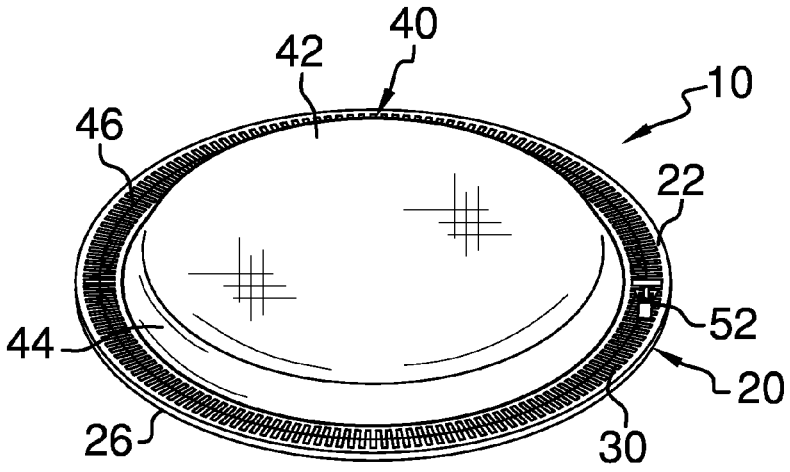
FIG. 1 is an isometric view with a top portion attached to a base portion.
Figure 2:
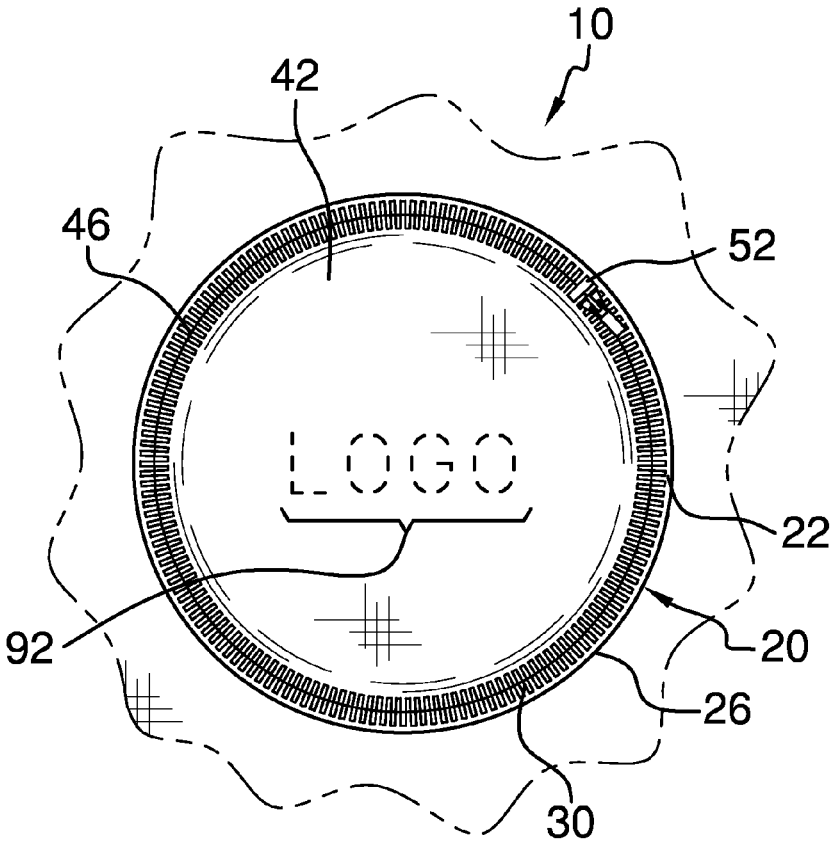
FIG. 2 is a top plan view.
Figure 3:
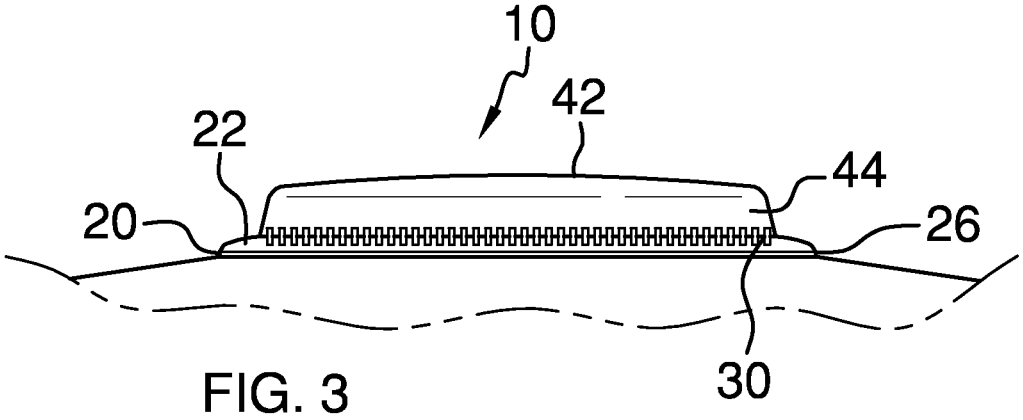
FIG. 3 is a side elevation view.
Figure 4:
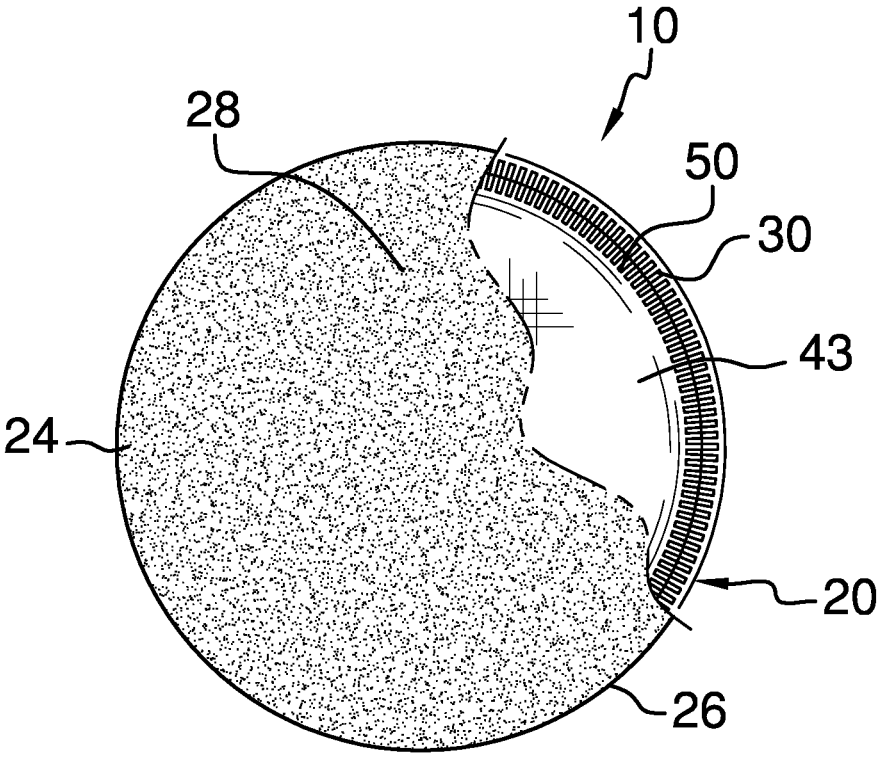
FIG. 4 is a bottom plan view.
Figure 5:
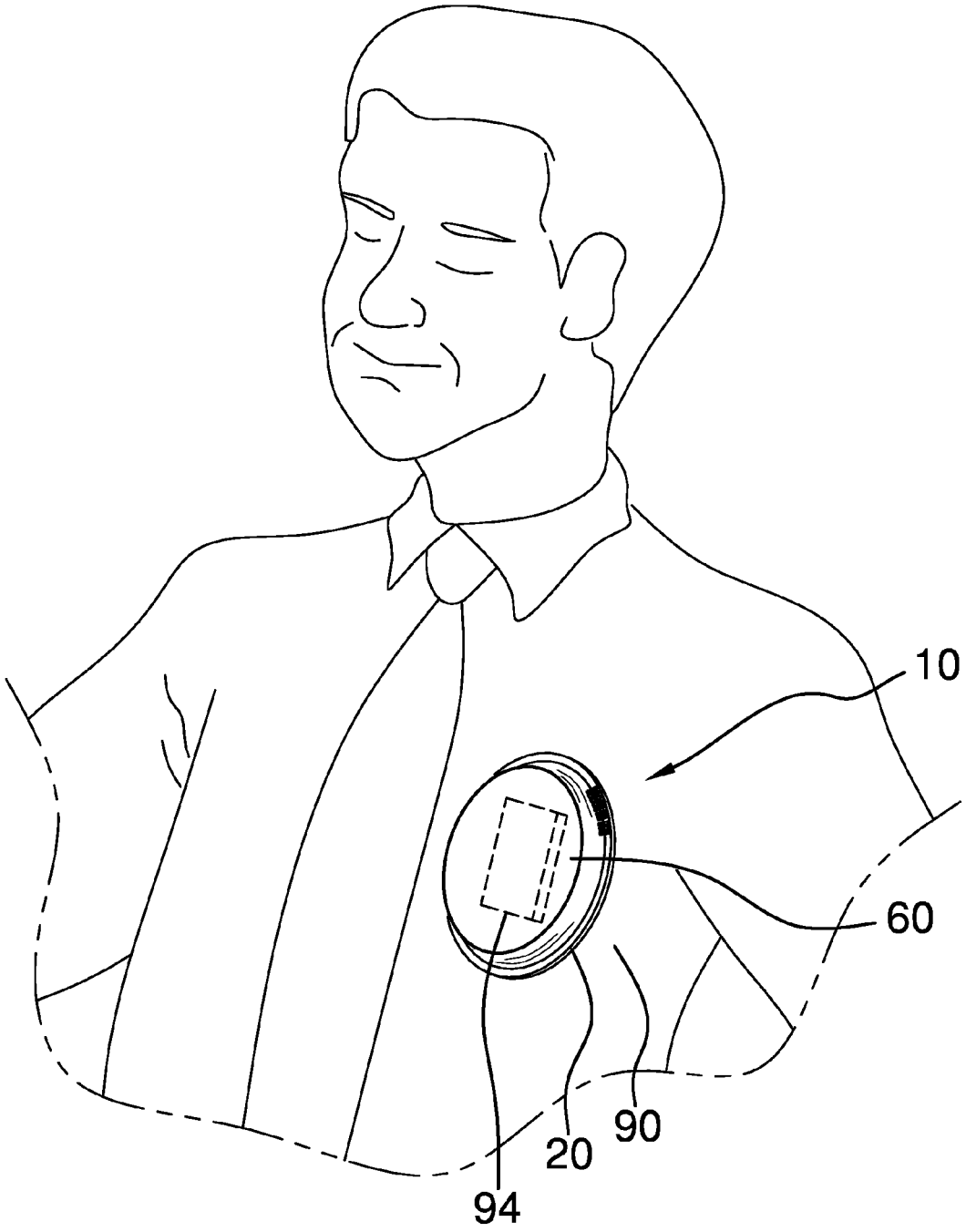
FIG. 5 is an in-use view.

With reference now to the drawings, and in particular FIGS. 1 through 5 thereof, example of the instant interchangeable patch device employing the principles and concepts of the present interchangeable patch device and generally designated by the reference number 10 will be described.

Referring to FIGS. 1 through 5 a preferred embodiment of the present interchangeable patch device 10 is illustrated. The interchangeable patch device 10 removably attaches to an item 90, such as an article of clothing, permitting a person to decorate personal items as desired. The patch device 10 includes a base portion 20. The base portion 20 has a front side 22, a rear side 24, and a first perimeter 26. An adhesive 28 is disposed on the entire rear side 24 of the base portion 20 allowing the base portion rear side to attach to the item 90. A first zipper track 30 is continuously disposed along the entire base portion 20 first perimeter 26. The adhesive 28 may be an iron-on adhesive or glue.

The present patch device 10 also includes a top portion 40 that removably centrally attaches to the base portion 20 and that has the substantially the same shape and dimensions as the base portion 20. The top portion 40 has a top side 42, an opposite bottom side 43, a second perimeter 46, and a continuous wall 44 disposed between the top side 42 and the second perimeter 46. A second zipper track 50 is continuously disposed along the second perimeter. The first zipper track 30 and the second zipper track 50 releasably interlock. A zipper pull 52 operationally alternately interlocks and releases the second zipper track 50 with and from, respectively, the first zipper track 30 in a closed position and open position, respectively. The top portion 40 is completely detachable from the base portion 20 to permit the top portion 40 to be replaced with a different top portion 40 which has the same dimensions.

An internal cavity 60 is defined by the top portion 40 bottom side 43, the top portion 40 wall 44, the second zipper track 50, and the base portion 20 front side 22. The top portion 40 top side 42 bears at least one indicia 92 thereon. The internal cavity 60 removably contains an object 94 therein, such as a cellular phone, business cards, a pen, an I-pod, an MP3 player, money. In an open position, the object 94 may be placed into the internal cavity 60 and then the object 94 is entirely contained therein when the first zipper track 30 and the second zipper track 50 are completely interlocked in a closed position.

What is claimed is:

1. An interchangeable patch device that is configured to removably attach to an item, the patch device consisting of:

a base portion having a front side, a rear side, and a first perimeter;

an adhesive disposed on the entire rear side;

a first zipper track continuously disposed along the entire base portion first perimeter;

a top portion having a top side, an opposite bottom side; a second perimeter, and a continuous wall disposed between the top side and the second perimeter, the top portion removably attached to the base portion, the top portion being centrally disposed atop the base portion;

a second zipper track continuously disposed along the second perimeter;

wherein the first zipper track and the second zipper track releasably interlock;

a zipper pull operationally alternately interlocking and releasing the second zipper track with and from, respectively, the first zipper track in a closed position and open position, respectively;

an internal cavity defined by the top portion bottom side, the top portion wall, the second zipper track, and the base portion front side; and at least one indicia disposed on the top portion top side;

wherein the top portion has a shape substantially identical to a shape of the base portion;

wherein the top portion has a size substantially identical to a size of the base portion; and wherein the base portion rear side is configured to attach to an item.

2. An interchangeable patch device that is configured to removably attach to an item, the patch device consisting of:

a base portion having a front side, a rear side, and a first perimeter;

an adhesive disposed on the entire rear side;

a first zipper track continuously disposed along the entire base portion first perimeter;

a top portion having a top side, an opposite bottom side; a second perimeter, and a continuous wall disposed between the top side and the second perimeter, the top portion removably attached to the base portion, the top portion being centrally disposed atop the base portion;

a second zipper track continuously disposed along the second perimeter;

wherein the first zipper track and the second zipper track releasably interlock;

a zipper pull operationally alternately interlocking and releasing the second zipper track with and from, respectively, the first zipper track in a closed position and open position, respectively; and an internal cavity defined by the top portion bottom side, the top portion wall, the second zipper track, and the base portion front side;

wherein the top portion has a shape substantially identical to a shape of the base portion;

wherein the top portion has a size substantially identical to a size of the base portion;

wherein the base portion rear side is configured to attach to an item;

wherein the top portion top side bears at least one indicia thereon;

wherein the internal cavity is configured to removably contain an object therein;

wherein the item is an article of clothing; and wherein the object is a cellular phone.

3. An interchangeable patch device that is configured to removably attach to an item, the patch device consisting of:

a base portion having a front side, a rear side, and a first perimeter;

an adhesive disposed on the entire rear side;

a first zipper track continuously disposed along the entire base portion first perimeter;

a top portion having a top side, an opposite bottom side; a second perimeter, and a continuous wall disposed between the top side and the second perimeter, the top portion removably attached to the base portion, the top portion being centrally disposed atop the base portion;

a second zipper track continuously disposed along the second perimeter;

wherein the first zipper track and the second zipper track releasably interlock;

a zipper pull operationally alternately interlocking and releasing the second zipper track with and from, respectively, the first zipper track in a closed position and open position, respectively; and an internal cavity defined by the top portion bottom side, the top portion wall, the second zipper track, and the base portion front side;

wherein the base portion rear side is configured to attach to an item;

wherein the top portion top side bears at least one indicia thereon;

wherein the indicia is a logo;

wherein the internal cavity is configured to removably contain an object therein;

wherein the item is an article of clothing;

wherein the top portion has a shape substantially identical to a shape of the base portion; and wherein the top portion has a size substantially identical to a size of the base portion.

* * * * *